US008042207B2

(12) United States Patent
Ito et al.

(10) Patent No.: US 8,042,207 B2
(45) Date of Patent: Oct. 25, 2011

(54) HOLDING MECHANISM FOR FOLDABLE SIDE RAILS

(75) Inventors: Yoshifumi Ito, Tokyo (JP); Yuhei Shiokura, Tokyo (JP); Akio Ishimoto, Tokyo (JP); Tetsuro Aoki, Tokyo (JP)

(73) Assignee: Paramount Bed Company, Ltd., Tokyo (JP)

( * ) Notice: Subject to any disclaimer, the term of this patent is extended or adjusted under 35 U.S.C. 154(b) by 0 days.

(21) Appl. No.: 12/833,719

(22) Filed: Jul. 9, 2010

(65) Prior Publication Data

US 2011/0000019 A1 Jan. 6, 2011

Related U.S. Application Data

(62) Division of application No. 12/013,609, filed on Jan. 14, 2008.

(30) Foreign Application Priority Data

Jan. 15, 2007 (JP) ..... 2007-006393

(51) Int. Cl.
*A47C 21/08* (2006.01)

(52) U.S. Cl. ..... 5/430; 5/428

(58) Field of Classification Search ..... 5/424, 425, 5/428, 430, 662; 403/91, 92; 292/29, 137, 292/143, 145, 150, 302, 163, 169, 173, 175, 292/DIG. 63, DIG. 29

See application file for complete search history.

(56) References Cited

U.S. PATENT DOCUMENTS 5,052,461 A * 10/1991 Stern ..... 160/224
5,123,687 A 6/1992 Pfeiffer et al.

FOREIGN PATENT DOCUMENTS

JP 11-104187 A 4/1999
JP 3029026 B2 2/2000

OTHER PUBLICATIONS

Office Action dated Jun. 25, 2009 from U.S. Appl. No. 12/013,609.

* cited by examiner

*Primary Examiner* — Robert G Santos
*Assistant Examiner* — Nicholas Polito
(74) *Attorney, Agent, or Firm* — McDermott Will & Emery LLP

(57) ABSTRACT

The conventional holding mechanism for foldable side rails have such problems that the release lever can be accidentally pressed for release action and that if a double lock is employed for preventing it, automatic holding action cannot be performed.

This invention proposes a holding mechanism for foldable side rails, characterized in that the holding mechanism 4 is provided at an end of an upper horizontal rail member 1*u* and comprises a mechanism support member 5 connected with the stanchion member provided at said end; the mechanism support member 5 has a stopper pin set 12 capable of advancing and receding; the stopper pin set 12 is biased in the advancing direction by a spring 13; the stanchion member has a fitting hole 10 allowing the stopper pin set 12 to be fitted in it when the stanchion member is kept erect; the mechanism support member further has a release lever 6 engaged with a mechanically driven trigger site 15 provided in connection with the stopper pin set for making the stopper pin set recede against the force of the spring; a play mechanism is provided between the release lever and the mechanically driven trigger site; and the mechanism support member further has a release prevention mechanism for preventing the movement of the release lever in the release allowing direction.

7 Claims, 14 Drawing Sheets

HOLDING MECHANISM FOR FOLDABLE SIDE RAILS

This application is a Divisional of U.S. patent application Ser. No. 12/013,609, filed on Jan. 14, 2008, and claims priority under 35 U.S.C. §119 to Japanese Patent Application No. 2007-006393, filed on Jan. 15, 2007, the entire contents of each of which are hereby incorporated by reference.

INCORPORATION BY REFERENCE

The present application claims priority under 35 U.S.C. §119 to Japanese Patent Application No. 2007-6393 filed on Jan. 15, 2007. The content of the application is incorporated herein by reference in its entirety.

FIELD OF THE INVENTION

The present invention relates to a holding mechanism for foldable side rails of a bed, especially for foldable side rails that have plural stanchion members pivotally rotatably connected between an upper horizontal rail member and a lower horizontal rail member, to form a parallel link mechanism, wherein said holding mechanism is provided for keeping the stanchion members erect.

BACKGROUND OF THE INVENTION

Various rails have been proposed as side rails of beds. Among them, a conventional technique of foldable side rails that have plural stanchion members pivotally rotatably connected between an upper horizontal rail member and a lower horizontal rail member, to form a parallel link mechanism, wherein a holding mechanism is provided for keeping the stanchion members erect is described, for example, in Japanese Patent No. 3029026.

In the foldable side rails described in the patent document, the holding mechanism is provided at an end of the upper horizontal rail member and comprises a mechanism support member connected with the stanchion member provided at the end; the mechanism support member has a stopper pin set biased in the advancing direction by a spring; the stanchion member has a fitting hole capable of having the stopper pin set fitted in it when the stanchion member is kept erect; a release action site for allowing the stopper pin set to recede against the force of the spring is provided directly at the rear of the stopper pin set; and the bottom side of the release action site is exposed downward from the bottom of the mechanism support member. Further, the mechanism support member has a lock member capable of being moved between the release preventing position and the release allowing position for the release action site.

In the above constitution, when the stanchion members are kept erect, with the tip of the stopper pin set fitted in the fitting hole, the side rails have the upper horizontal rail member kept at the highest position in the state of use. In this constitution, a slope face for allowing the stopper pin set to slide on it is formed near the fitting hole, so that when the horizontal rail members are raised to keep the stanchion members erect, the stopper pin set can be automatically fitted into the fitting hole.

In the case where the lock member is set at the release preventing position with the stopper pin set fitted in the fitting hole, even if the release action site exposed downward from the bottom of the mechanism support member is accidentally touched to apply a force in the release allowing direction, the release action site is prevented from moving by the lock member and cannot move. Therefore, the tip of the stopper pin set remains fitted in the fitting hole, and the stanchion members and the horizontal rail members are kept in the state of use safely.

The conventional foldable side rails as described above have the following disadvantages.

1. The release action site provided of the stopper pin set is exposed downward from the bottom of the mechanism support member. So, if a force in the release allowing direction is applied owing to an accidental touch in the case where the lock member is not set at the release preventing position, it can dangerously happen that the stopper pin set is disengaged from the fitting hole and that the stanchion members fall while the upper horizontal rail member drops.

2. In the stowed state where the stanchion members fall while the upper horizontal rail member is kept at the lowest position, if the lock member is moved to the release preventing position and the horizontal rail members are raised to keep the stanchion members erect, then the stopper pin set is kept projected to interfere with the stanchion member having the fitting hole. Therefore, the stopper pin set cannot be automatically fitted into the fitting hole.

The object of this invention is to solve the above problems.

SUMMARY OF THE INVENTION

To solve the above-mentioned problems, this invention proposes a holding mechanism for foldable side rails that have plural stanchion members pivotally rotatably connected between an upper horizontal rail member and a lower horizontal rail member, to form a parallel link mechanism, said holding mechanism being provided for keeping the stanchion members erect, characterized in that the holding mechanism is provided at an end of the upper horizontal rail member and comprises a mechanism support member connected with the stanchion member provided at said end; the mechanism support member has a stopper pin set capable of advancing and receding; the stopper pin set is biased in the advancing direction by a spring; the stanchion member provided at the end has a fitting hole for allowing the stopper pin set to be fitted in it when the stanchion member is kept erect; the mechanism support member further has a release lever engaged with a mechanically driven trigger site provided in connection with the stopper pin set, for making the stopper pin set recede against the force of the spring; a play mechanism is provided between the release lever and the mechanically driven trigger site; and the mechanism support member further has a release prevention mechanism for preventing the movement of the release lever in the release allowing direction.

This invention proposes said constitution, wherein the play mechanism consists of a slot formed in the mechanically driven trigger site and a pin installed in the release lever and engaged with the slot.

This invention proposes said composition, wherein the play mechanism consists of a recess formed in the mechanically driven trigger site and opening in the horizontal direction and a pin installed in the release lever and engaged with the recess.

This invention proposes said composition, wherein as the release prevention mechanism, a lock member with a contact portion to be kept in contact with the upper face of the release lever is movably provided in the upper portion of the mechanism support member, while a recess designed to avoid contact with the contact portion is formed in the upper face of the release lever, in the case where the release lever is moved upward for release action. In this case, the recess can be formed as the lower horizontal one of two horizontal levels.

This invention proposes said constitution, wherein as the release prevention mechanism, the lock member is biased by a spring in the direction in which the release prevention mechanism acts.

This invention proposes said constitution, wherein the mechanism support member can function as a cover for covering mechanism components and has a pocket formed partially in the place where the release lever is pressed for release action.

In the foldable side rails of this invention, the holding mechanism used to keep the stanchion members erect has a play mechanism formed between the release lever and the mechanically driven trigger site. So, even in the state where the release prevention mechanism for preventing the movement of the release lever in the release allowing direction is set at the release preventing position, when the horizontal rail members are raised to keep the stanchion members erect, the stopper pin set can be automatically fitted into the fitting hole.

The release lever to be pressed for release action is exposed in the pocket of the mechanism support member, that is, the place in which the release lever is pressed for release action is contained in the pocket. So, an accidental action error can be prevented.

The lock member as the release prevention mechanism can be manually moved in both the release preventing direction and the release allowing direction, or can also be biased in the release preventing direction by a spring and manually moved in the release allowing direction against the force of the spring. In the latter case, a failure to move the release prevention mechanism in the release preventing direction can be avoided highly safely.

PREFERRED EMBODIMENT OF THE INVENTION

This invention is explained below in detail in reference to the drawings showing embodiments.

Embodiment 1

FIGS. 1 through 12 show a first embodiment of this invention.

Figure 1:
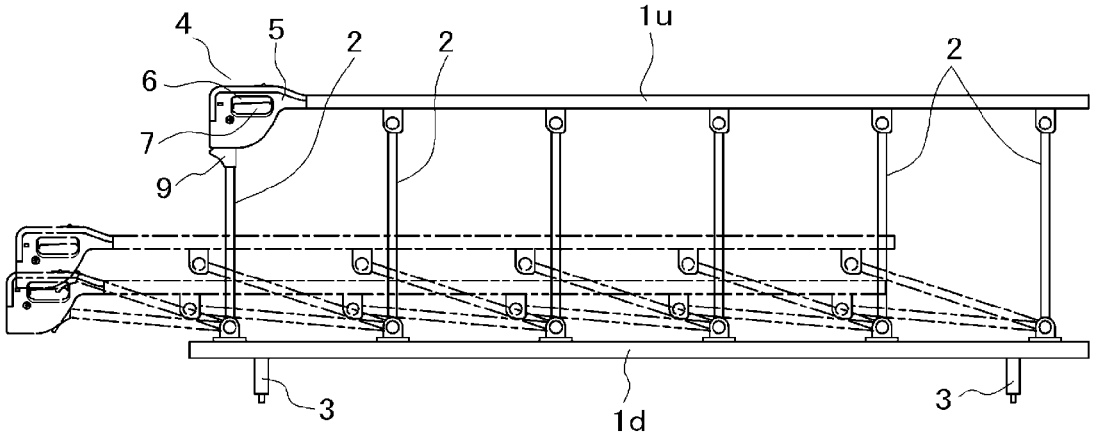
FIG. 1 is an illustration showing an example of the entire constitution of the foldable side rails to which the holding mechanism of this invention is applied.

FIG. 1 shows an example of the entire constitution of the foldable side rails to which this invention is applied. Symbol 1*u* denotes an upper horizontal rail member and symbol 1*d* denotes a lower horizontal rail member. Plural stanchion members 2, six stanchion members in the drawing, are pivotally rotatably connected between the upper horizontal rail member 1*u* and the lower horizontal rail member 1*d*, to form a parallel link mechanism.

Symbols 3 and 3 are attaching rods projected downward from the lower horizontal rail member 1*d*, and the attaching rods 3 are fitted into the fitting holes formed in the top surface of a bed frame (not shown), to install the side rails on a lateral side of the bed.

Symbol 4 generally shows the holding mechanism of this invention, and symbol 5 denotes a mechanism support member to be installed at an end, the left end in the drawings, of the upper horizontal rail member 1*u*. The mechanism support member 5 is provided as a cover for covering the mechanism components described later and has a pocket 7 formed at about the central portion of it, to expose the hand trigger site 6*d* of the release lever 6 described later.

Figure 2:
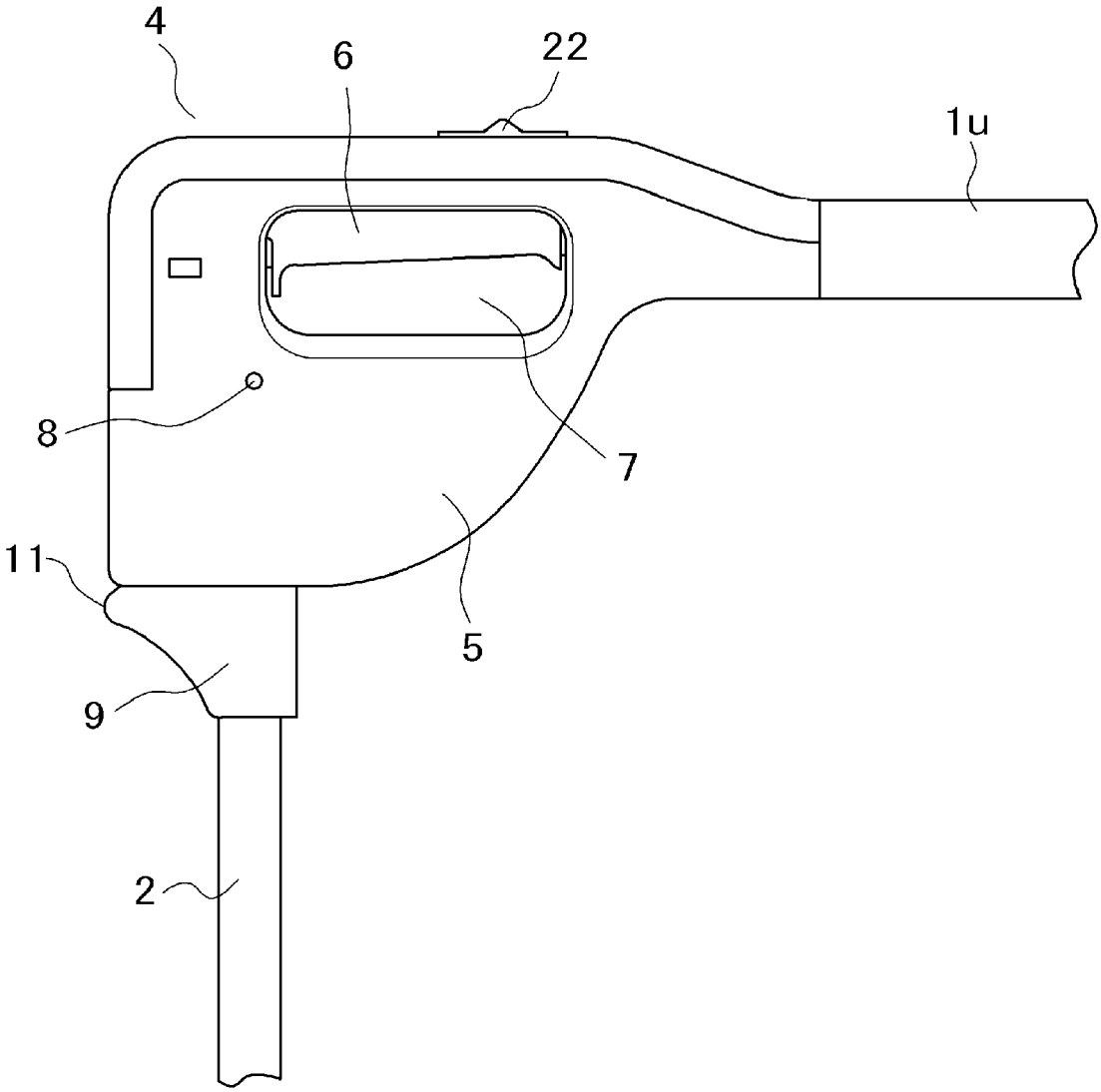
FIG. 2 is an illustration showing the appearance of a first embodiment of the holding mechanism of this invention.
Figure 3:
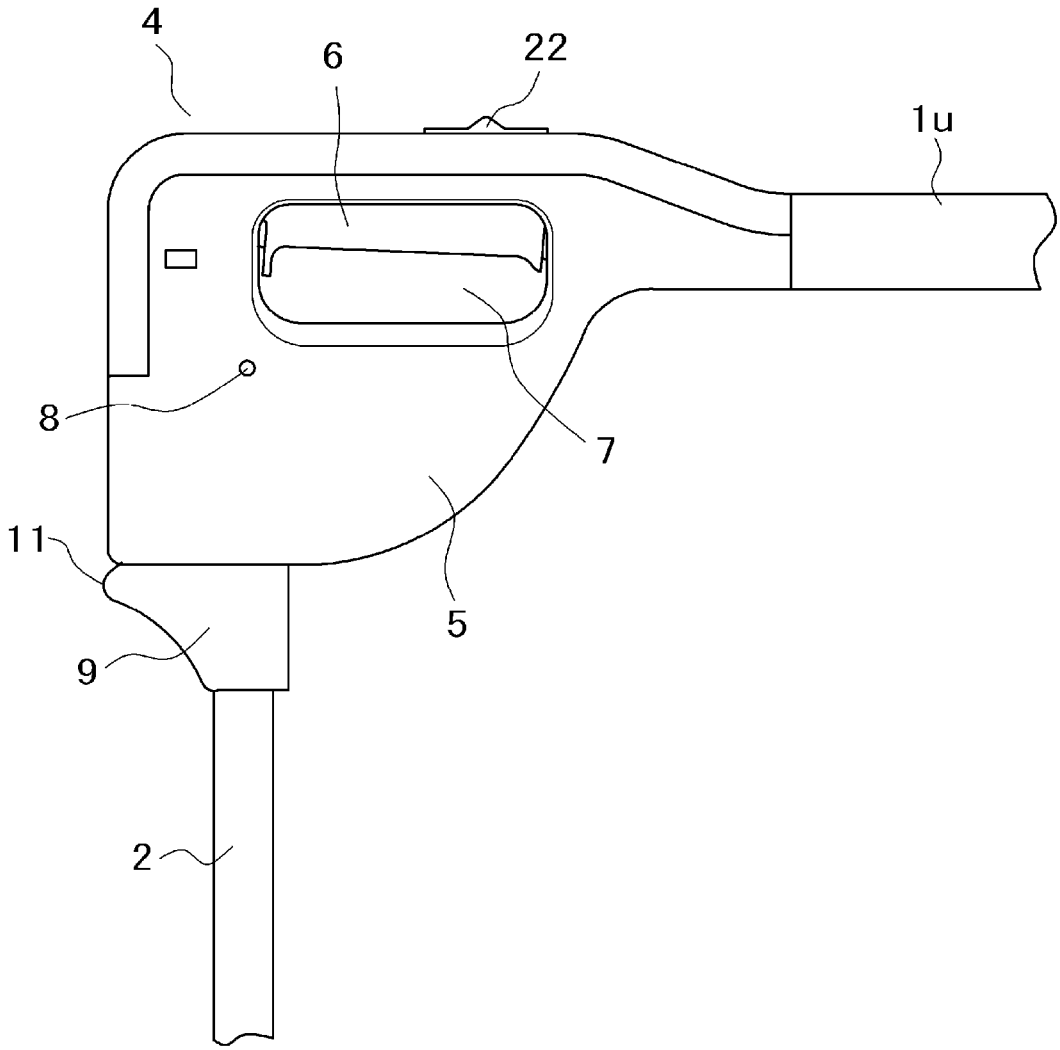
FIG. 3 is an illustration showing the appearance of the first embodiment of the holding mechanism of this invention in another phase.
Figure 4:
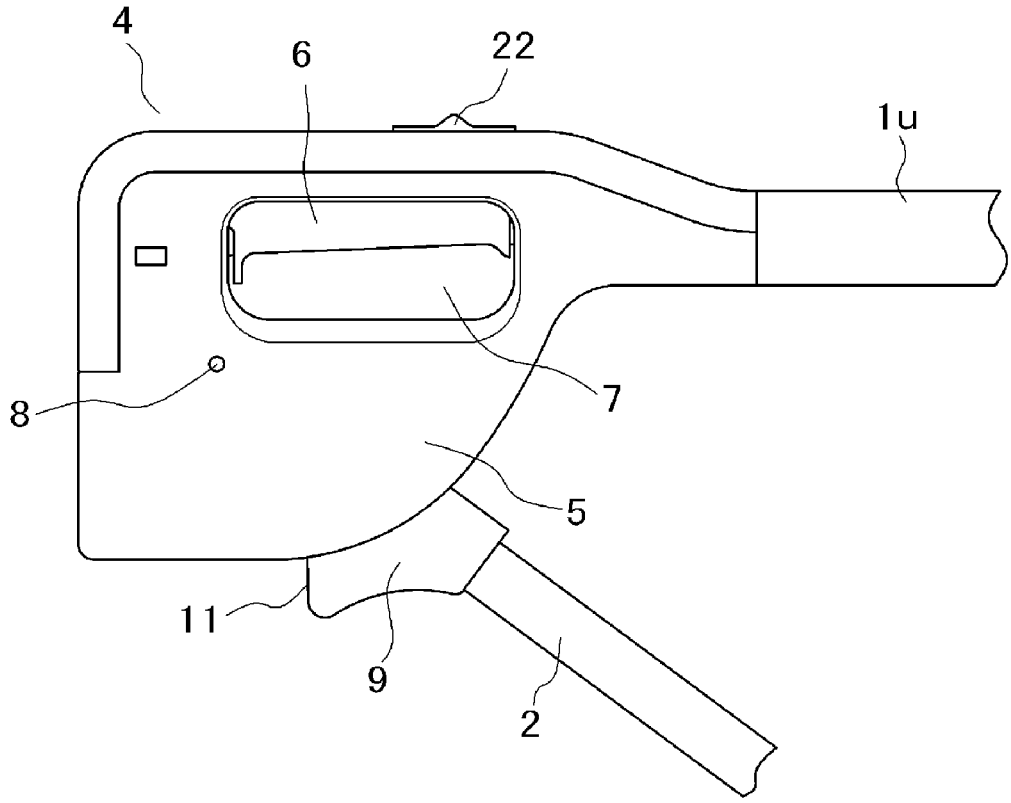
FIG. 4 is an illustration showing the appearance of the first embodiment of the holding mechanism of this invention in a further other phase.
Figure 11:
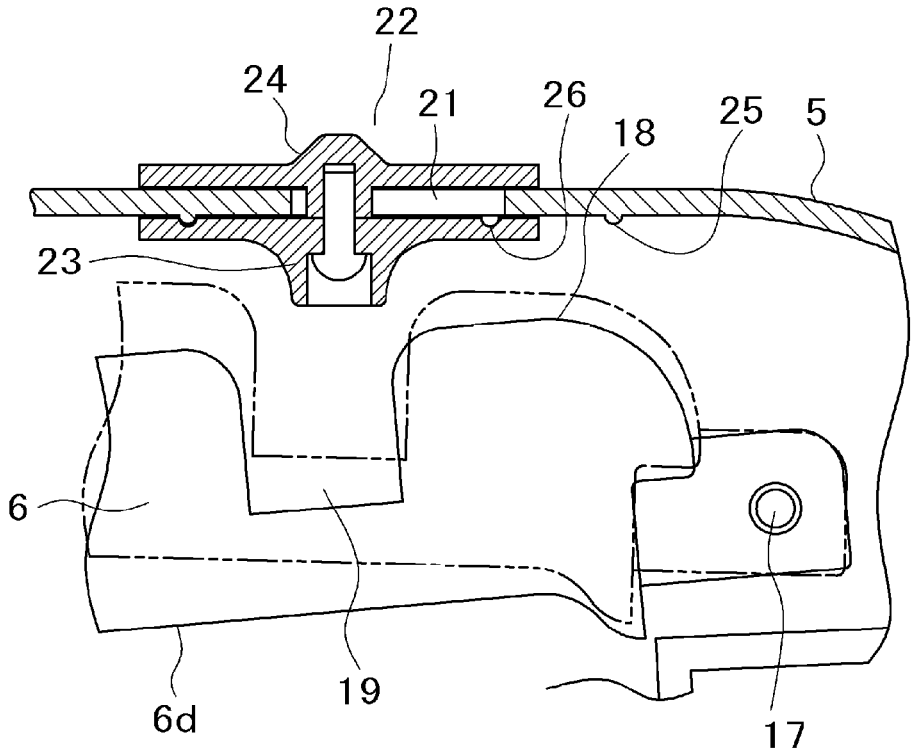
FIG. 11 is an illustration showing the detail of the lock mechanism in the first embodiment of the holding mechanism of this invention.
Figure 12:
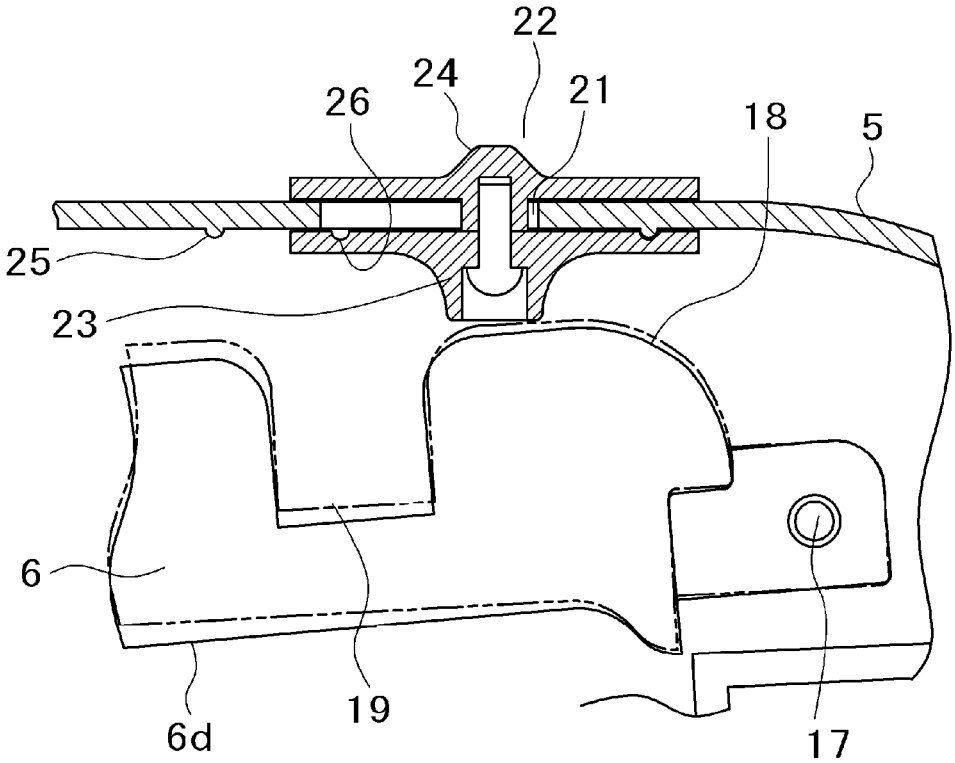
FIG. 12 is an illustration showing the detail of the lock mechanism in the first embodiment of the holding mechanism of this invention in another phase.

FIGS. 2 through 4 show the appearance of the holding mechanism in this embodiment. FIG. 3 shows a state where the release lever has been pressed from the state of FIG. 2. FIGS. 5 through 10 show the detail of the holding mechanism 4. FIGS. 11 and 12 are enlarged views of essential portions. The first embodiment of the holding mechanism 4 of this invention is explained below in detail in reference to these drawings.

As shown in the drawings, the stanchion member 2, namely, the stanchion member 2 at the left end of FIG. 1 in this case, is pivotally rotatably connected with the mechanism support member 5 at a pivot 8. A member 9 attached to the stanchion member 2 has a fitting hole 10 formed, and the member 9 has a slope portion 11 formed beside the fitting hole 10.

On the other hand, the mechanism support member 5 supports a stopper pin set 12 at a position corresponding to the position of the fitting hole 10 when the stanchion member 2 is kept erect, in such a manner that the stopper pin set 12 can advance and recede, namely, can move vertically in the drawings. The stopper pin set 12 is biased in the advancing direction, namely, downward in the drawings, by a spring 13 such as a compression coil spring. Meanwhile, as shown in the drawings, the stopper pin set 12 has a small diameter portion projected at its tip, to be fitted in the fitting hole. Symbol 14 denotes a cylinder for supporting the stopper pin set 12 in such a manner that the stopper pin set 12 can advance and recede. At the rear of the stopper pin set 12, namely, above the stopper pin set 12 in the drawings, a mechanically driven trigger site 15 is formed, and the mechanically driven trigger site 15 has a slot 16 formed in the vertical direction.

On the other hand, in the mechanism support member 5, the release lever 6 is pivotally rotatably supported by a pivot 17, and the lower side portion 6*d* of the release lever 6 is exposed as a hand trigger site in the pocket 7.

The upper side portion of the release lever 6 protrudes above, and a recess 19 is formed on the left side of a protrusion 18 on the right side.

Further, on the left side of the release lever 6, a pin 20 is installed. The pin 20 is engaged with the slot 16 formed in the mechanically driven trigger site 15 at the rear of the stopper pin set 12.

Furthermore, at the top of the mechanism support member 5, a lock member 22 capable of moving in the horizontal direction in the drawings is provided in a slot 21 formed in the horizontal direction in the drawings. On the lower side of the lock member 22, a protrusion 23 is formed in such a manner that it can contact the protrusion 18 of the release lever 6, and on the upper side of it, a protrusion 24 is formed to be used for moving the lock member. Moreover, as shown in FIGS. 11 and 12 on the underside of the top plate of the mechanism support member 5, projections 25 are formed on both sides to hold the lock member 22 moving in the horizontal direction in position, and depressions 26 corresponding to them are formed in the lock member 22.

Figure 5:
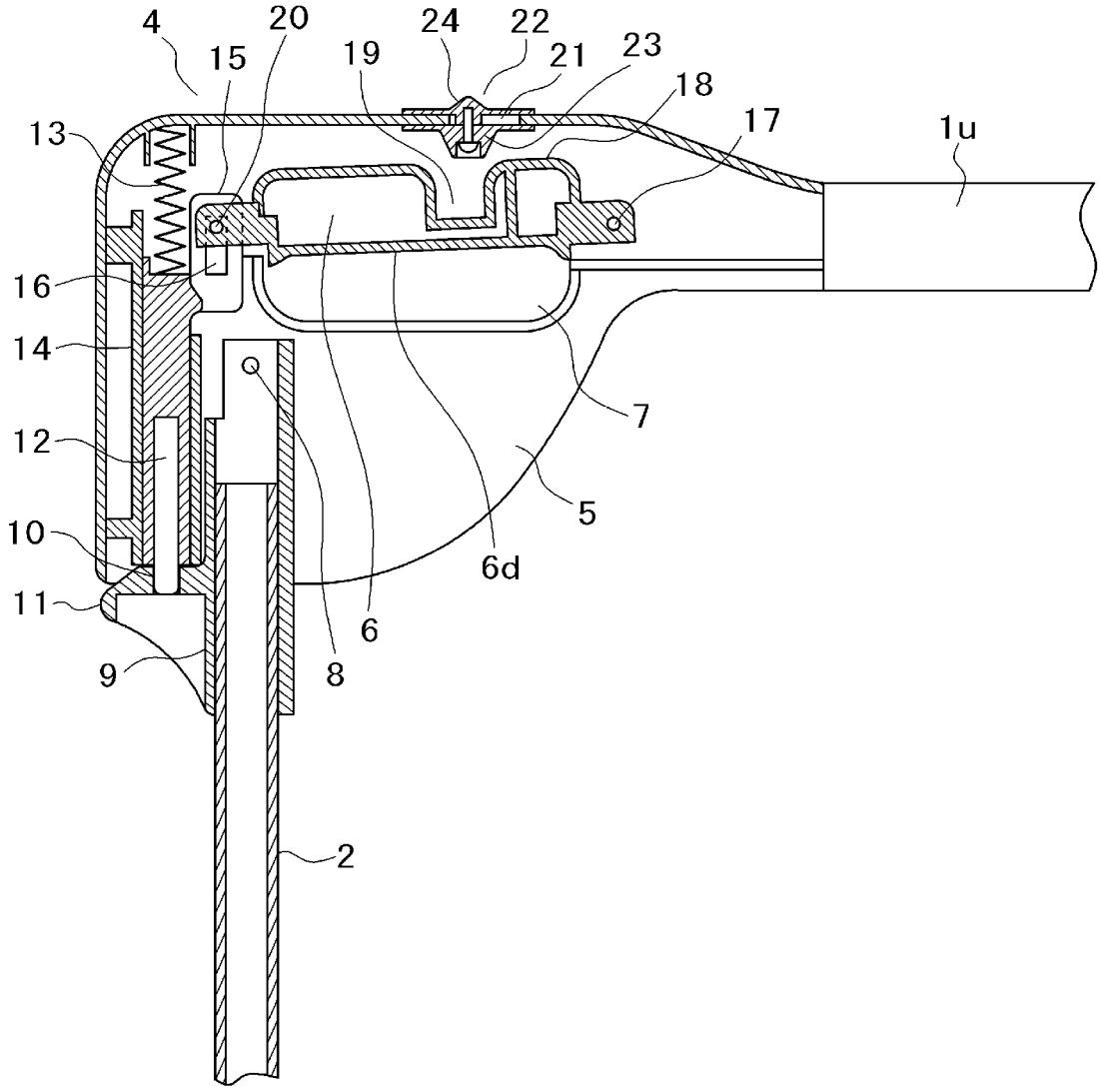
FIG. 5 is an illustration showing the detail of the first embodiment of the holding mechanism of this invention.

In the above constitution, in FIG. 5, the stanchion member 2 is kept erect, and the tip of the stopper pin set 12 is fitted in the fitting hole 10, being biased by the spring 13. Therefore, the stanchion member 2 is held in such a manner that it cannot be rotated around the pivot 8 relatively to the mechanism support member 5, hence the upper horizontal rail member 1*u*. So, in the side rails, the stanchion member 2 is kept erect and the upper horizontal rail member 1*u* is kept at the highest position. Further, in FIG. 5, the lock member 22 is kept in the state of FIG. 11, and therefore, the release lever 6 can be pressed for release action.

Figure 6:
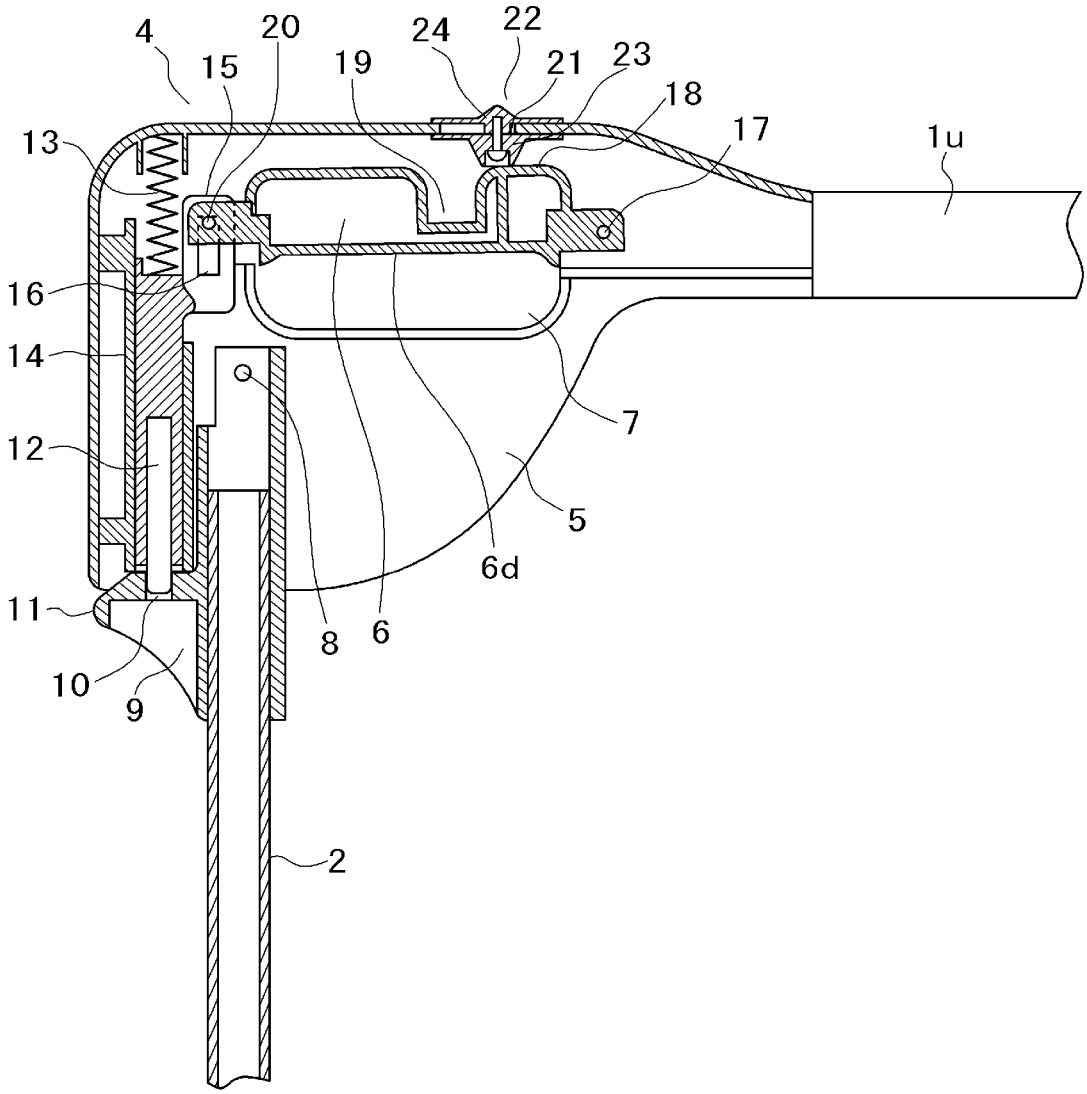
FIG. 6 is an illustration showing the detail of the first embodiment of the holding mechanism of this invention in another phase.

In the case where the lock member 22 is moved rightward as shown in FIG. 6, to reach the state of FIGS. 6 and 12, even if the hand trigger site 6*d* of the release lever 6 is pressed upward, the release lever 6 cannot be moved upward at all, since the protrusion 18 of the release lever 6 contacts the protrusion 23 of the lock member 22.

In this embodiment as described above, since the hand trigger site 6*d* of the release lever 6 is contained in the pocket 7 formed in the mechanism support member 5 functioning as a cover, it is difficult to accidentally press the hand trigger site 6*d*, and even if the hand trigger site 6*d* is accidentally pressed, the lock member 22 prevents the accidental movement of the release lever 6, to assure double safety.

Figure 7:
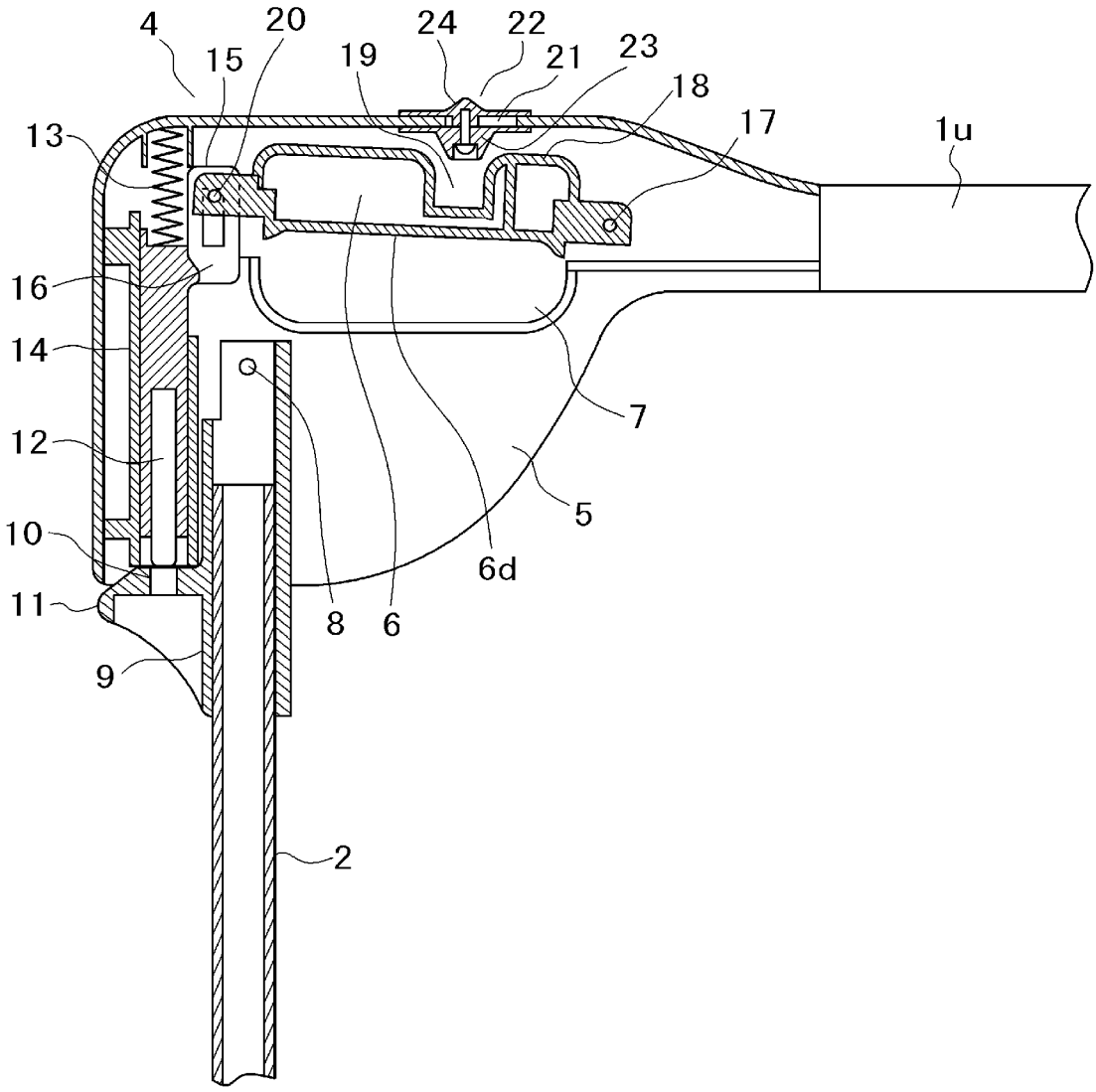
FIG. 7 is an illustration showing the detail of the first embodiment of the holding mechanism of this invention in a further other phase.

In the case where the side rails are stowed, that is, in the case where the stanchion members 2 are pivotally rotated to descend for lowering the upper horizontal rail member 1*u*, the lock member 22 is moved leftward in the drawings, to reach the released state of FIGS. 5 and 11, and subsequently the hand trigger site 6*d* exposed in the pocket 7 is manually pressed upward. As a result, the release lever 6 is rotated around the pivot 17 clockwise in the drawings. The pivotal rotation moves the pin 20 upward, and the pin moves the top end of the slot 16. So, the mechanically driven trigger site 15 moves the stopper pin set 12 upward against the force of the spring 13. Thus, as shown in FIG. 7, the tip of the stopper pin set 12 recedes to be disengaged from the fitting hole 10.

Figure 8:
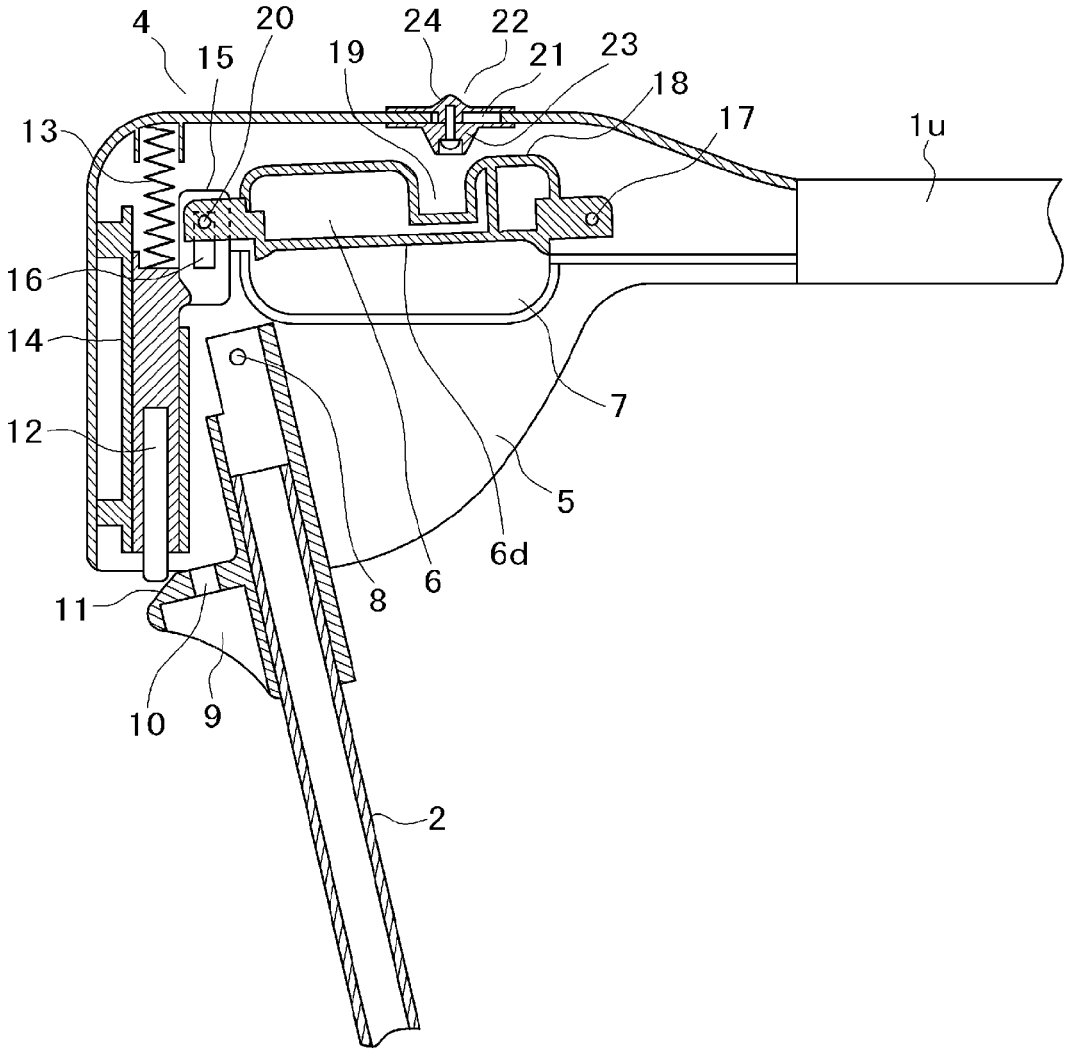
FIG. 8 is an illustration showing the detail of the first embodiment of the holding mechanism of this invention in a still further other phase.
Figure 9:
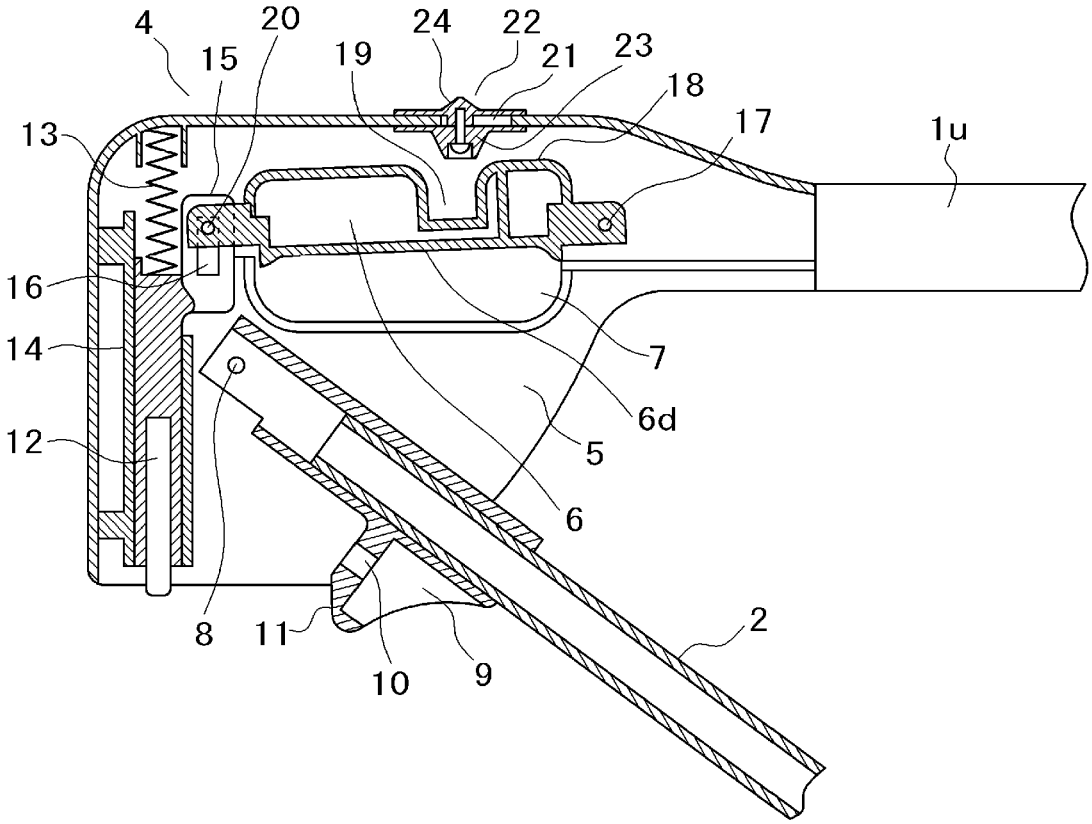
FIG. 9 is an illustration showing the detail of the first embodiment of the holding mechanism of this invention in a still further other phase.

In this state, the stanchion member 2 can be pivotally rotated from the state of FIG. 8 to the state of FIG. 9, and therefore, the upper horizontal rail member 1*u* can be lowered in parallel in the parallel link mechanism.

Figure 10:
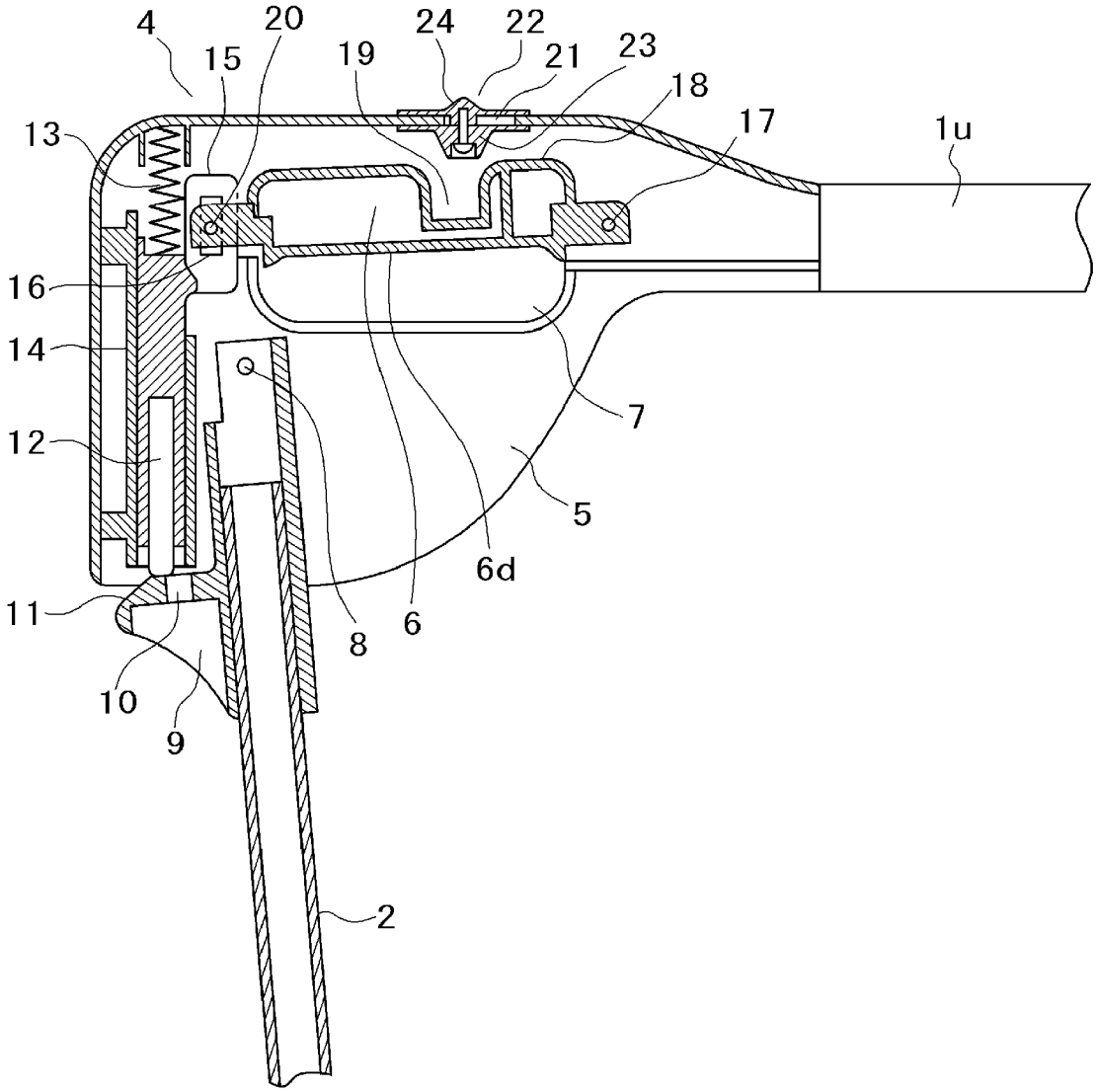
FIG. 10 is an illustration showing the detail of the first embodiment of the holding mechanism of this invention in a still further other phase.

On the contrary, if the upper horizontal rail member 1*u* is raised from the state of FIG. 9 to the state of FIG. 8, and further raised to pivotally rotate the stanchion member 2 relatively clockwise in FIG. 8, the slope portion 11 of the member 9 makes the stopper pin set 12 recede as shown in FIG. 10, and then when the stopper pin set 12 corresponds to the fitting hole 10, the force of the spring 13 causes the stopper pin set 12 to fit in the fitting hole 10. Thus, the fitting state shown in FIGS. 5 and 2 can be automatically achieved.

As can be seen also from FIG. 10, since a play mechanism, namely, a play mechanism consisting of the slot 16 formed in the mechanically driven trigger site 15 and the pin 20 installed in the release lever 6 is provided between the release lever 6 and the stopper pin set 12 in this invention, the stopper pin set 12 and the mechanically driven trigger site 15 can be moved without giving an external force to the release lever 6, when the upper horizontal rail member 1*u* is raised.

So, in the state of FIG. 8, even if the lock member 22 is brought to the position of FIGS. 6 and 12, the stopper pin set 12 can be made to recede from the fitting hole 10 as in the state of FIG. 10. Therefore, as in FIG. 10, the slope portion 11 of the member 9 makes the stopper pin set 12 recede, and then when the stopper pin set 12 corresponds to the fitting hole 10, the force of the spring 13 causes the stopper pin set 12 to fit in the fitting hole. Thus, the fitting state shown in FIG. 5 can be automatically achieved.

Thus in this invention, in other than the case where the release lever 6 is pressed for inclining the stanchion member 2 from the state where the stanchion member 2 is kept erect, the lock member 22 can be kept in the lock state to enhance safety.

Meanwhile, in the first embodiment described above, the play mechanism consists of the slot 16 formed in the mechanically driven trigger site 15 and the pin 20 installed in the release lever 6. However, another appropriate play mechanism as shown in the following second embodiment can also be applied.

Embodiment 2

Figure 13:
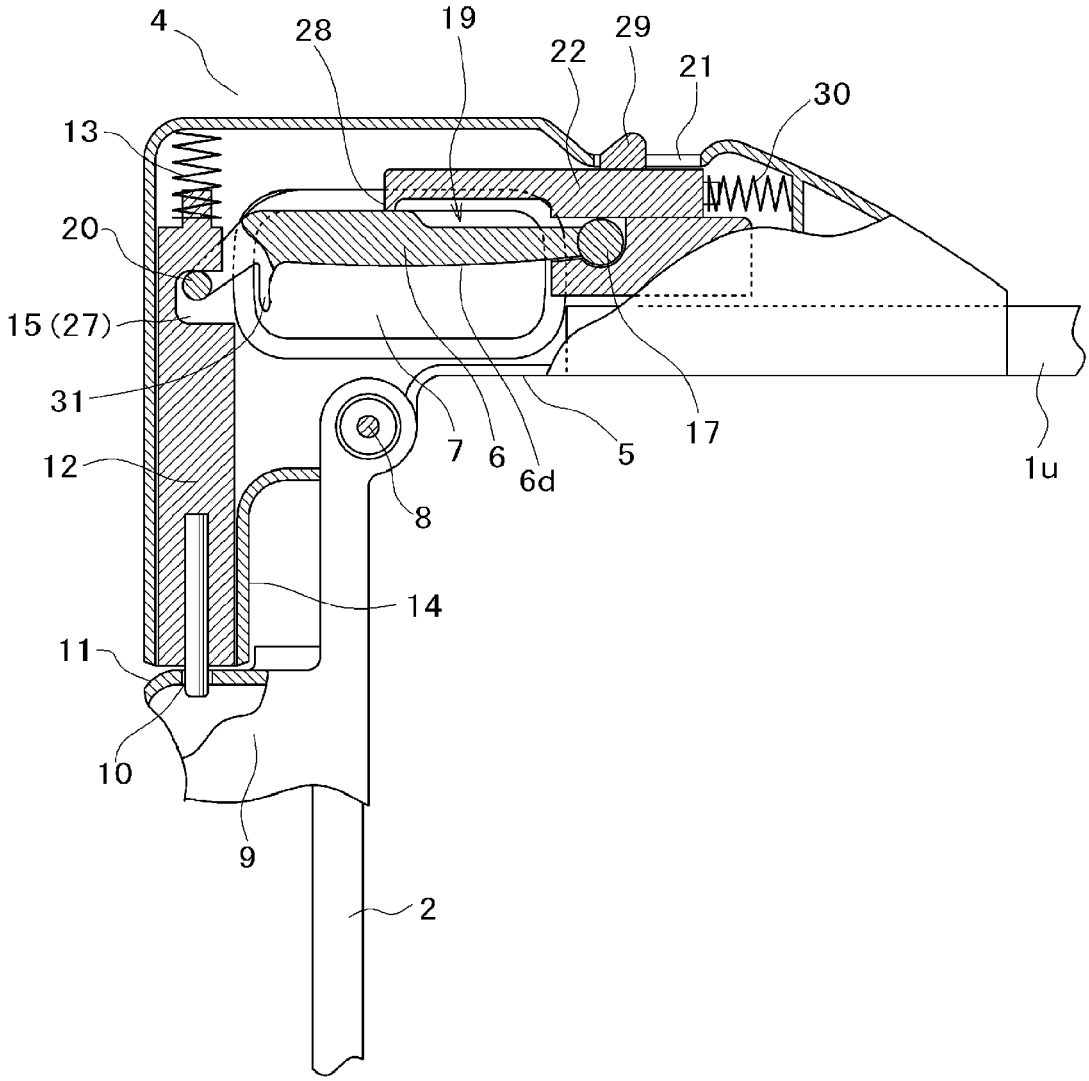
FIG. 13 is an illustration showing the detail of the second embodiment of the holding mechanism of this invention.
Figure 14:
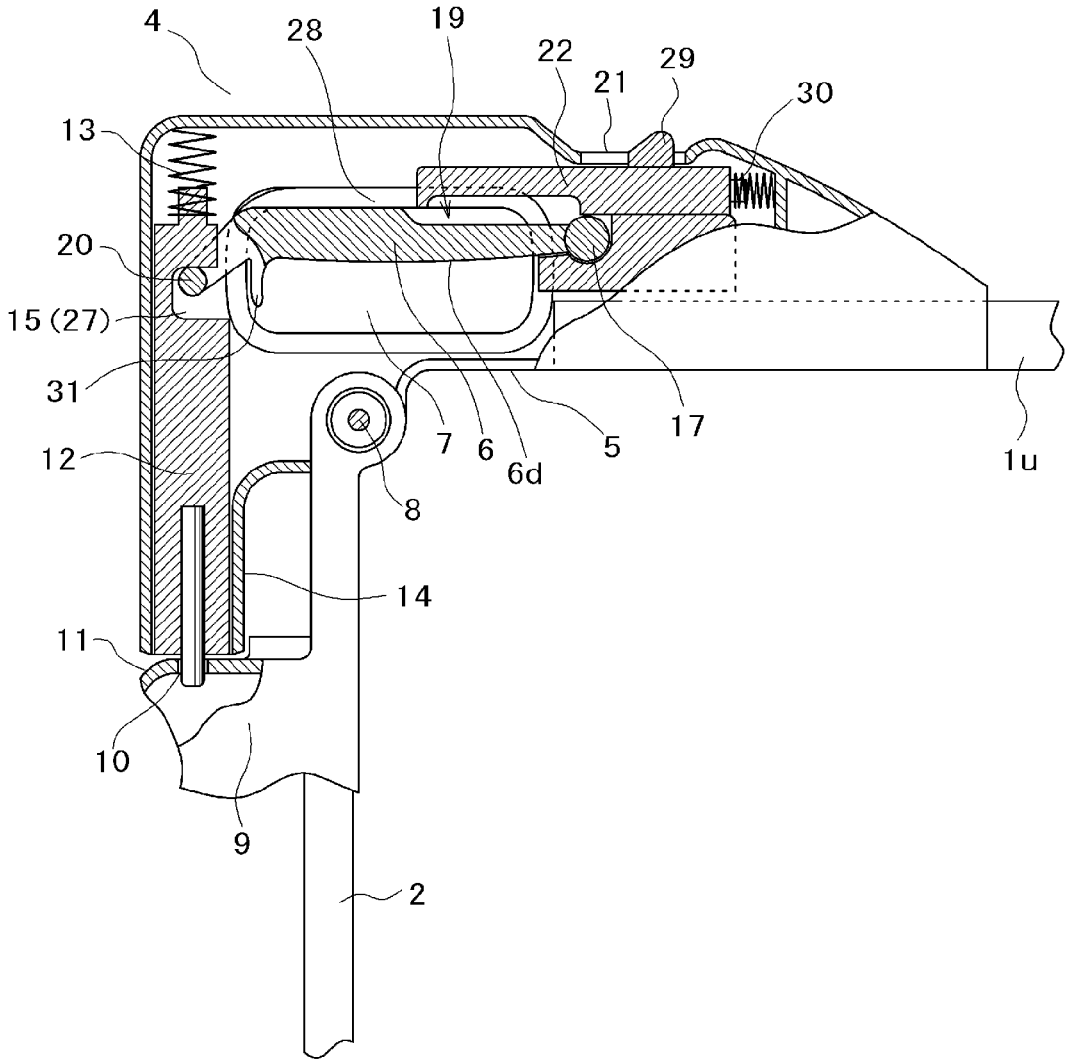
FIG. 14 is an illustration showing the detail of the second embodiment of the holding mechanism of this invention in another phase.
Figure 15:
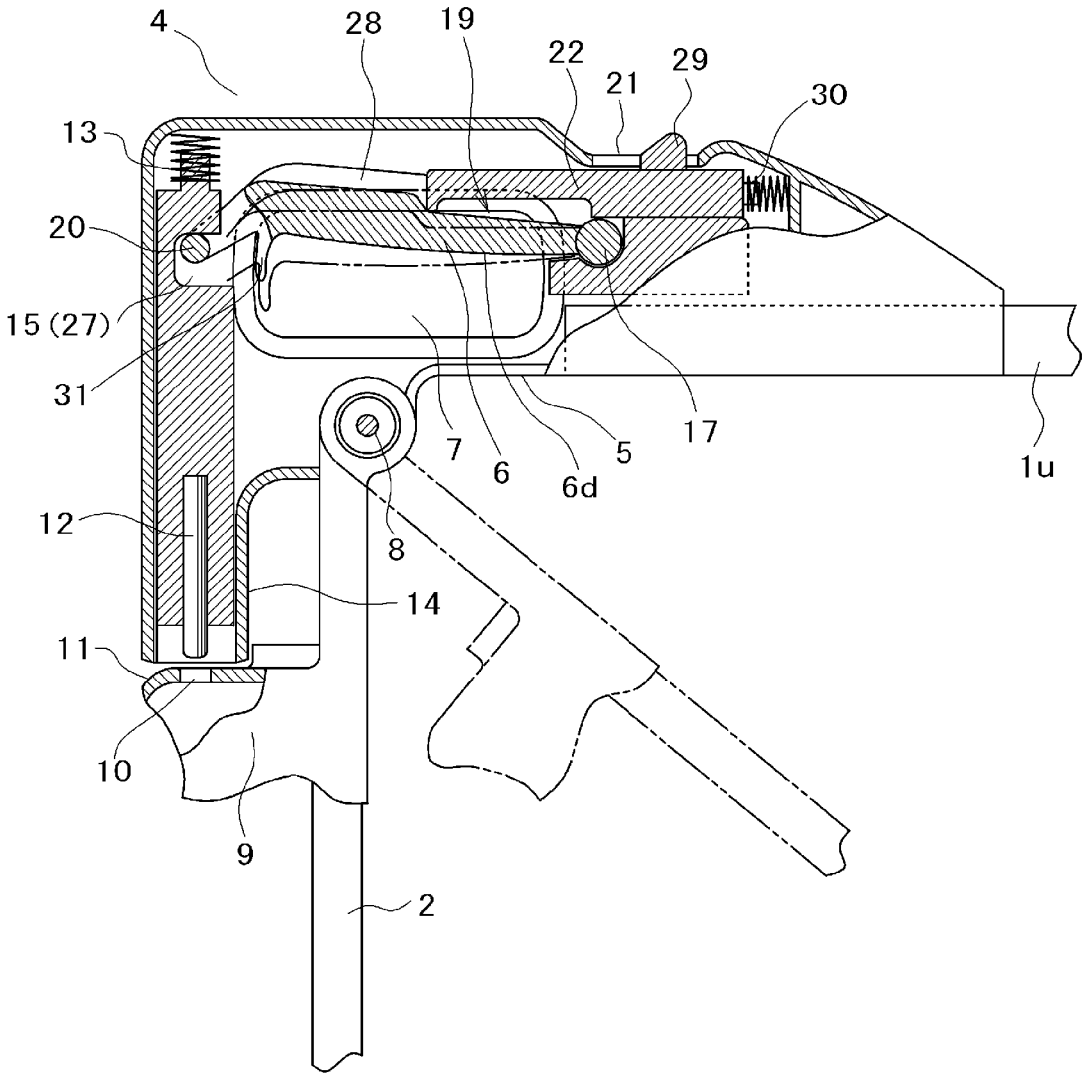
FIG. 15 is an illustration showing the detail of the second embodiment of the holding mechanism of this invention in a further other phase.

FIGS. 13 through 15 show a second embodiment of the holding mechanism for foldable side rails of this invention. This embodiment is different from the first embodiment in the play mechanism and the release prevention mechanism only. So, the corresponding components are given the same symbols.

As shown in FIGS. 13 through 15, a stanchion member 2 is connected with a mechanism support member 5 in such a manner that it can be rotated around a pivot 8. Further, a member 9 attached to the stanchion member 2 has a fitting hole 10 formed and further has a slope portion 11 formed beside the fitting hole 10.

The mechanism support member 5 supports a stopper pin set 12 at a position corresponding to the position of the fitting hole 10 when the stanchion member 2 is kept erect, in such a manner that the stopper pin set 12 can advance and recede, namely, can move vertically in the drawings. The stopper pin set 12 is biased in the advancing direction, namely, downward in the drawings, by a spring 13 such as a compression coil spring. Meanwhile, as in the first embodiment, the stopper pin set 12 has a small diameter portion projected at its tip and fitted in the fitting hole 10, as shown in the drawings. Symbol 14 denotes a cylinder for supporting the stopper pin set 12 in such a manner that the stopper pin set 12 can advance and recede. At the rear of the stopper pin set 12, namely, above the stopper pin set 12 in the drawings, a mechanically driven trigger site 15 is formed, and the mechanically driven trigger site 15 has a recess 27 formed to open in the horizontal direction.

In the mechanism support member 5, the release lever 6 is supported in such a manner that it can be rotated around a pivot 17, and the lower side portion 6*d* of the release lever 6 is exposed as a hand trigger site in the pocket 7 formed in the mechanism support member 5.

Further, the upper side portion of the release lever 6 is formed to have two horizontal levels, with the upper horizontal level on the left side and the lower horizontal level 19 on the right side.

A pin 20 is installed on the left side of the release lever 6, and the pin 20 is engaged with the recess 27 of the mechanically driven trigger site 15 of the stopper pin set 12. Meanwhile, symbol 31 denotes a guide member.

Further, the mechanism support member 5 supports a lock member 22 above the upper side portion of the release lever 6 in such a manner that the lock member can move horizontally in the drawings, and on the lock member 22, a lock member-moving protrusion 29 is formed. The lock member-moving protrusion 29 protrudes outside the mechanism support member 5 through a horizontal slot 21. Thus, the lock member can be moved in the horizontal direction, and the lock member-moving protrusion 29 can be used to move the lock member.

In this embodiment, the lock member 22 is biased leftward by a spring such as a compression coil spring. Further, the lock member 22 has a protrusion 28 formed under its tip on the left side, which contacts the upper side portion of the release lever 6.

In the above constitution, in FIG. 13, the stanchion member 2 is kept erect, and the tip of the stopper pin set 12 is fitted in the fitting hole 10, being biased by the spring 13. Therefore, the stanchion member 2 is held in such a manner that it cannot be rotated around the pivot 8 relatively to the mechanism support member 5, hence the upper horizontal rail member 1*u*. So, in the side rails, the stanchion member 2 is kept erect and the upper horizontal rail member 1*u* is kept at the highest position.

In this case, the lock member 22 is biased leftward by the spring 30, and contacts the upper horizontal level of the upper side portion of the release lever 6. In this state, even if the hand trigger site 6*d* of the release lever 6 is pressed upward, the release lever 6 cannot be moved upward at all, since the upper side portion of the release lever 6 contacts the protrusion 28 of the lock member 22.

In this embodiment as described above, since the hand trigger site 6*d* of the release lever 6 is contained in the pocket 7 formed in the mechanism support member 5 functioning as a cover, it is difficult to accidentally press the hand trigger site 6*d*, and even if the hand trigger site 6*d* is accidentally pressed, the lock member 22 prevents the accidental movement of the release lever 6, to assure double safety.

Meanwhile, in the case where the lower horizontal level 19 is formed as one of two horizontal levels as in this embodiment, the lock member 22 is not necessarily required to have the protrusion 28. Further, if the protrusion 28 is formed, the upper side portion of the release lever 6 can have protrusions on both sides instead of forming the two horizontal levels including the lower horizontal level 19.

In the case where the side rails are stowed, that is, in the case where the stanchion member 2 is pivotally rotated to decline for lowering the upper horizontal rail member 1*u*, at first, the lock member-moving protrusion 29 is moved rightward in the drawings against the force of the spring 30 as shown in FIG. 14.

Then in this state, if the hand trigger site 6*d* exposed in the pocket 7 is manually pressed upward, the release lever 6 is rotated around a pivot 17 clockwise in the drawings. This pivotal rotation moves the pin 20 upward, and the pin 20 moves the top end of the recess 27. So, the mechanically driven trigger site 15 moves the stopper pin set 12 upward against the force of the spring 13. Thus, as shown in FIG. 15, the tip of the stopper pin set 12 recedes to be disengaged from the fitting hole 10, and in this state, the stanchion member 2 can be pivotally rotated as shown by the two-dot-dash line of FIG. 15. Therefore, the upper horizontal rail member 1*u* can be lowered in parallel as a parallel link mechanism.

Then, if the upper horizontal rail member 1*u* kept lowered is raised without pressing the release lever 6, to pivotally rotate the stanchion member 2 clockwise relatively from the state of the two-dot-dash line to the state of the solid line, the slope portion 11 of the member 9 makes the stopper pin set 12 recede as in the first embodiment, and subsequently when the stopper pin set 12 corresponds to the fitting hole 10, the force of the spring 13 causes the stopper pin set 12 to be fitted in the fitting hole 10. Thus, the fitting state shown in FIG. 13 can be achieved automatically.

That is, since a play mechanism, namely, a play mechanism consisting of the recess 27 formed in the mechanically driven trigger site 15 and the pin 20 installed in the release lever 6 is provided between the release lever 6 and the stopper pin set 12, the stopper pin set 12 and its mechanically driven trigger site 15 can be moved without giving an external force to the release lever 6, when the upper horizontal rail member 1*u* is raised. So, even if the lock member 22 is moved to the release prevention side of the release prevention mechanism by the force of the spring 30, the state of FIG. 13 can be achieved without any problem.

Thus in this invention, in other the case where the release lever 6 is operated in the state where the stanchion member 2 is kept erect, the lock member can be automatically kept in the lock state by the force of the spring 30 to enhance safety.

In the above explanation, in the release prevention mechanism of the first embodiment, the lock member can be manually moved in both the release preventing direction and the release allowing direction, and the release prevention mechanism of the second embodiment is biased in the release preventing direction by a spring and manually moved in the release allowing direction against the force of the spring. Contrary to the above, the lock member in the release prevention mechanism of the first embodiment can be biased by a spring, or the lock member in the release prevention mechanism of the second embodiment can be moved manually without the force of a spring.

INDUSTRIAL APPLICABILITY

The holding mechanism for foldable side rails of this invention as described above has the following features.

1. Even in the state where the release prevention mechanism for preventing the movement of the release lever in the release allowing direction is set at the release preventing position, when the horizontal rail members are raised to keep the stanchion members erect, the stopper pin set can be automatically fitted into the fitting hole.

2. The release lever is pressed for release action in the place exposed in the pocket of the mechanism support member, that is, the place in which the release lever is pressed for release action is contained in the pocket. So, an accidental action error can be prevented.

3. If the release prevention mechanism is biased automatically by a spring, safety can be further enhanced.

The foldable side rails of this invention can be used to partially cover a lateral side of a bed or to entirely cover a lateral side of a bed. They can also be attached to a bed by any appropriate method.

What is claimed is:

1. A holding mechanism for foldable side rails, comprising:

an upper horizontal rail member;

a lower horizontal rail member;

at least two stanchion members pivotally rotatably connected between the upper horizontal rail member and the lower horizontal rail member, forming a parallel link mechanism, the holding mechanism keeping the stanchion members erect, and is disposed at an end of the upper horizontal rail member; and a mechanism support member connected to at least one of the stanchion members provided at said end, and comprising:

a spring;

a stopper pin set capable of advancing and receding;

a stopper pin set disposed to receive the stopper pin on one end and contact the spring on the other;

wherein the at least one of the stanchion members has a fitting hole for allowing the stopper pin set to be fitted in it when the stanchion members are kept erect;

a mechanically driven trigger site;

a release lever engaged with the mechanically driven trigger site provided in connection with the stopper pin set, for making the stopper pin set recede against the force of the spring;

a play mechanism provided between the release lever and the mechanically driven trigger site;

a release prevention mechanism preventing the movement of the release lever in the release allowing direction, the play mechanism configured so that the stopper pin can be automatically fitted into the fitting hole when the upper and lower horizontal rail members are raised; and a cover enclosing at least one of the spring, stopper pin set, cylinder, and release prevention mechanism, having a pocket formed partially in the place where the release lever is pressed for release action, wherein the spring is disposed between the cover and the cylinder, and wherein the stopper pin set is biased in the advancing direction by the spring.

2. The holding mechanism for foldable side rails, according to claim 1, wherein the play mechanism comprises a recess formed in the mechanically driven trigger site and opening in the horizontal direction and a pin installed in the release lever and engaged with the recess.

3. The holding mechanism for foldable side rails, according to claim 1, wherein the release prevention mechanism, further comprises a lock member, comprising:

a contact portion to be kept in contact with an upper face of the release lever; and a recess designed to avoid contact with the contact portion formed in the upper face of the release lever, in the case where the release lever is moved upward for release action, and wherein the lock member is movably provided in the upper portion of the mechanism support member.

4. The holding mechanism for foldable side rails, according to claim 3, wherein the recess is formed as the lower horizontal one of two horizontal levels.

5. The holding mechanism for foldable side rails, according to claim 3, wherein the lock member is biased by a second spring in the direction in which the release prevention mechanism acts.

6. The holding mechanism for foldable side rails, according to claim 1, wherein:

a first force applied to the release lever to recede the stopper pin acts in a same direction as the recession of the stopper pin, and a second force applied to the release prevention mechanism acts approximately perpendicular to the first force.

7. The holding mechanism for foldable side rails, according to claim 1, wherein the pocket prevents erroneous operations of the release lever.

* * * * *